US005461777A

United States Patent [19]

Ikeda et al.

[11] Patent Number: 5,461,777

[45] Date of Patent: Oct. 31, 1995

[54] APPARATUS FOR MANUFACTURING A SILENCER

[75] Inventors: Tsukasa Ikeda, Ohmiya; Akihiko Tamano, Ageo, both of Japan

[73] Assignee: Sankei Giken Kogyo Kabushiki Kaisha, Tokyo, Japan

[21] Appl. No.: 228,035

[22] Filed: Apr. 15, 1994

[30] Foreign Application Priority Data

Apr. 19, 1993 [JP] Japan ..... 5-115446

[51] Int. Cl.[6] ..... B23P 15/00

[52] U.S. Cl. ..... 29/890.08; 29/234; 29/235

[58] Field of Search ..... 29/890.08, 234, 29/235, 240, 700

[56] References Cited

U.S. PATENT DOCUMENTS

| | | | |
|---|---|---|---|
| 3,259,206 | 7/1966 | Straw | 29/890.08 |
| 4,774,985 | 10/1988 | Broadbelt et al. | 29/890.08 |
| 5,092,122 | 3/1992 | Bambridge | 181/252 |
| 5,170,557 | 12/1992 | Rigsby | 29/890.08 |
| 5,329,698 | 7/1994 | Abbott | 29/890.08 |

*Primary Examiner*—Irene Cuda

*Attorney, Agent, or Firm*—Polster, Lieder Woodruff & Lucchesi

[57] ABSTRACT

The invention is directed to a method for easy and reliable manufacture of a silencer constructed with a multi-perforated inner tube and an outer tube, between which a sound-absorbing material such as glass wool, etc. is filled in, without use of a binding agent, etc. The invention is also directed to provide an apparatus for use in the manufacture of such silencer. In these method and apparatus for manufacturing the silencer, a long web of mat-shaped sound-absorbing material S is wound on and around the outer peripheral surface of the multi-perforated inner tube 1 in multiple layers and to a predetermined thickness; then, a pair of levelling members 2A, 2B, each having a semi-circular concavity which is substantially equal to the inner diameter of the outer tube, are gradually brought into contact with the outer peripheral surface of the sound-absorbing material S, while rotating the inner tube T1 with the sound-absorbing material S having been wound therearound, in its winding direction, to thereby level the outer diameter of the sound-absorbing material S to the inner diameter of the outer tube to a substantially equal degree; and the inner tube T1 is inserted into the outer tube T2 immovably fixed by the outer tube fixing means such as clamps 3A and 3B, while continuously rotating the inner tube T1.

2 Claims, 4 Drawing Sheets

APPARATUS FOR MANUFACTURING A SILENCER

BACKGROUND OF THE INVENTION a) Field of the Invention

This invention relates to a method for manufacturing a silencer (or muffler) for use in an internal combustion engine of an automobile, as an example. More particularly, it is concerned with a method for producing such silencer constructed with a multi-perforated inner tube and an outer tube, between which a sound-absorbing material such as glass wool, etc. is filled. The invention is also concerned with an apparatus for manufacturing such silencer.

b) Background of the Invention

There have so far been proposed various types of such silencer (or muffler) constructed with the multi-perforated inner tube, the outer tube, and the sound-absorbing material such as glass wool, etc. is filled in the space between these inner and kouter tubes. One example of such silencer is shown in FIGS. 6 and 7 of the accompanying drawing.

FIG. 6 illustrates a sound-absorbing type silencer to be used as a pre-chamber or a sub-muffler to be disposed on the way of the exhaust system of the internal combustion engine for automobiles, the main body M of which is constructed in an inner/outer double structure composed of a multi-perforated inner tube T1 made of a punched metal, etc. with multiple holes being formed therein and an outer tube T2, a sound-absorbing material S such as glass wool, etc. being filled in the space between both inner and outer tubes T1, T2. In the drawing, B1 and B2 designate end plates for closing the end parts of the inner and outer tubes T1, T2, while P1 and P2 refer to exhaust pipes connected to both end parts of the silencer main body M1.

FIG. 7 also illustrates a baffle type silencer (or muffler) to be used as the main muffler, etc. in the exhaust system such as described above, in which diffuser pipes D1, D2 for communicatively connecting a plurality of expansion chambers C1 to C3 defined in the silencer main body M are constructed with the multi-perforated inner tube T1 and the outer tube T2, and in which sound-absorbing material S such as glass wool, etc. is filled between the inner tube T1 and the outer tube T2.

In manufacturing the silencer constructed with the inner tube T1, the outer tube T2, and the sound absorbing material S interposed between both inner and outer tubes T1, T2 such as described above, it is a general practice to wind the sound-absorbing material S, in advance, on and around the outer periphery of the multi-perforated inner tube T1, as shown in FIG. 8 for example, after which this inner tube T1 is inserted into the outer tube T2.

Also, in order to exhibit favorable sound-muffling performance, the abovementioned sound-absorbing material S such as glass wool, etc. is required to be uniformly filled in between the inner and outer tubes T1, T2 at a predetermined density. However, since the sound-absorbing material S has elasticity, hence it is bulged outward more largely than the inner diameter of the outer tube T2, as shown in FIG. 8(*a*), it is difficult to insert the inner tube T1 covered with the sound-absorbing material S into the outer tube T2. If and when such inner tube is forced to push into the outer tube, there is such apprehension that fluctuation occurs in the filling density of the sound-absorbing material S, or the sound-absorbing material deforms prominently in the direction opposite to the direction of insertion of the inner tube T1 due to friction between these two, the sound-absorbing material and the outer tube, as shown in FIG. 8(*b*), with the consequence that it juts out from the end part of the outer tube T2, or the sound-absorbing material S melts out when the end plates B1, B2 are welded to the end parts of the outer tube T2, to bring about deterioration in the quality of the sound-absorbing material, or defects in such welding of the end plates. Further, when the winding quantity of the sound-absorbing material S on and around the inner tube T1 is reduced for its easy insertion into the outer tube T2, the packing density of the sound-absorbing material becomes short with the consequence that it does not exhibit satisfactory silencing performance.

Therefore, it has conventionally been a practice to impregnate the sound-absorbing material S with a binding agent by spraying or dipping, at the time of winding the sound-absorbing material S on and around the outer periphery of the inner tube T1, thereby making the outer dimeter of the sound-absorbing material S to be substantially equal to the inner diameter of the outer tube T2, followed by insertion of the inner tube T1 into the outer tube T2. However, when such binding agent as mentioned above is used, the sound-absorbing material S becomes solidified, which reduces the silencing performance. Among other things, the manufacturing cost of the silencer becomes increased, because impregnation and drying steps for the binding agent are required, and so forth.

One of the objects of this invention is to provide method and apparatus for permitting the space between a perforated inner tube and an outer tube of a silencer to be filled uniformly, snugly, with sound absorbing material, simply and effectively, in a way that permits rapid and economical manufacture of the silencer.

Other objects will become apparent to those skilled in the art in the light of the following description and accompanying drawing.

SUMMARY OF THE INVENTION

The present invention has been proposed in view of the abovementioned points of problem, and aims at providing a method for manufacturing the silencer (or muffler) capable of filling the sound-absorbing material between the inner tube and the outer tube in a simple and reliable manner without necessity for using the binding agent, etc. as is the case mentioned in the foregoing. The invention also aims at providing an apparatus for manufacturing such silencer.

With a view to attaining the abovementioned object, the method for manufacturing the silencer and the apparatus for manufacturing the silencer according to the present invention are constructed in the following manner.

In accordance with the present invention, a method for manufacturing a silencer with a sound-absorbing material such as glass wool, etc. filled in a space between a multi-perforated inner tube and an outer tube, which comprises steps of: winding on and around the outer peripheral surface of the multi-perforated inner tube a long web of mat-shaped sound-absorbing material, in multiple layers and to a predetermined thickness; then, gradually bringing a pair of levelling members, each having a semi-circular concavity which is substantially eqaul to the inner diameter of the outer tube, into contact with the outer peripheral surface of the sound-absorbing material, while rotating the inner tube with the sound-absorbing material having been wound therearound, in the winding direction of the sound-absorbing material, to thereby level the outer diameter of the sound-absorbing material to the inner diameter of the outer tube to a substantially equal degree; and inserting the inner tube into the outer tube, while continuously rotating the inner tube.

A the apparatus for manufacturing the silencer with a sound-absorbing material such as glass wool, etc. to occupy a space between a multi-perforated inner tube and an outer tube, comprises: driving means for rotationally driving the inner tube, which driving means holds at least the inner tube thereon and rotationally drives the same at a predetermined speed; a pair of levelling members, having, on mutually opposed surface sides, semi-arcuate concavities of a size substantially equal to the inner diameter of the outer tube, to level the outer diameter of the sound-absorbing material wound on and around the inner tube to make that diameter substantially equal to the inner diameter of the outer tube; and means for immobilizably fixing the outer tube. The pair of levelling members are disposed in a manner movable toward one another in the direction perpendicular to the axial direction of the inner tube when it is rotationally driven by the abovementioned inner tube driving means. The abovementioned outer tube immobilizing means is disposed adjacent to the levelling members.

BRIEF DESCRIPTION OF ACCOMPANYING DRAWING

In the drawing:

FIG. 1 longitudinal cross-sectional view showing one embodiment of the apparatus for manufacturing the silencer according to the present invention;

FIGS. 2(*a*) and 2(*b*) are each cross-sectional views of levelling members.

FIGS. 3(*a*) to 3(*c*) are respectively explanatory views of the process steps for manufacturing the silencer according to the present invention;

FIGS. 4(*a*) and 4(*b*) are each cross-sectional views showing another embodiment of the levelling members.

DETAILED DESCRIPTION OF PREFERRED EMBODIMENTS

According to the abovementioned method of manufacturing the silencer of the present invention, an inner tube with sound-absorbing material having been wound therearound can be easily loaded in the outer tube by rotating the same in the winding direction of the sound-absorbing material to tightly wind the sound-absorbing material therearound to reduce its outer diameter, and, at the same time, by bringing the levelling members into contact with the sound-absorbing material to level its outer diameter to a substantially equal level as the inner diameter of the outer tube, followed by insertion of the inner tube into the outer tube, with continuous rotation of the inner tube. Incidentally, when the inner tube is rotated in the reverse direction to the winding direction of the sound-absorbing material, after its insertion into the outer tube at a predetermined position, the tightening force of the sound-absorbing material as wound on and around the inner tube becomes weak, and the sound-absorbing material, due to its elastic restitutive force, is distributed uniformly in the space bwetween the inner tube and the outer tube without deviation, thereby making it possible to render the packing density of the sound-absorbing material to be uniform.

Further, according to the apparatus for manufacturing the silencer of the present invention, as mentioned above, it becomes possible to execute the abovementioned process steps for its manufacture with a simple construction, which comprises: driving means for rotationally driving an inner tube, which holds at least the inner tube thereon and rotationally drives the same at a predetermined speed; a pair of levelling membershaving, on their mutually opposed surface sides, semi-arcuate concavities of a size substantially equal to the inner diameter of the outer tube, to level the outer diameter of the sound-absorbing material wound on and around the inner tube to be substantially equal to the inner diameter of the outer tube; and means for immobilizably fixing the outer tube.

With a view to enabling those persons skilled in the art to readily practise the present invention, detailed explanations will be given hereinbelow with reference to preferred embodiments of the method for manufacturing the silencer as well as the apparatus to be used for its manufacture, as illustrated in the accompanying drawing.

Figure 1:
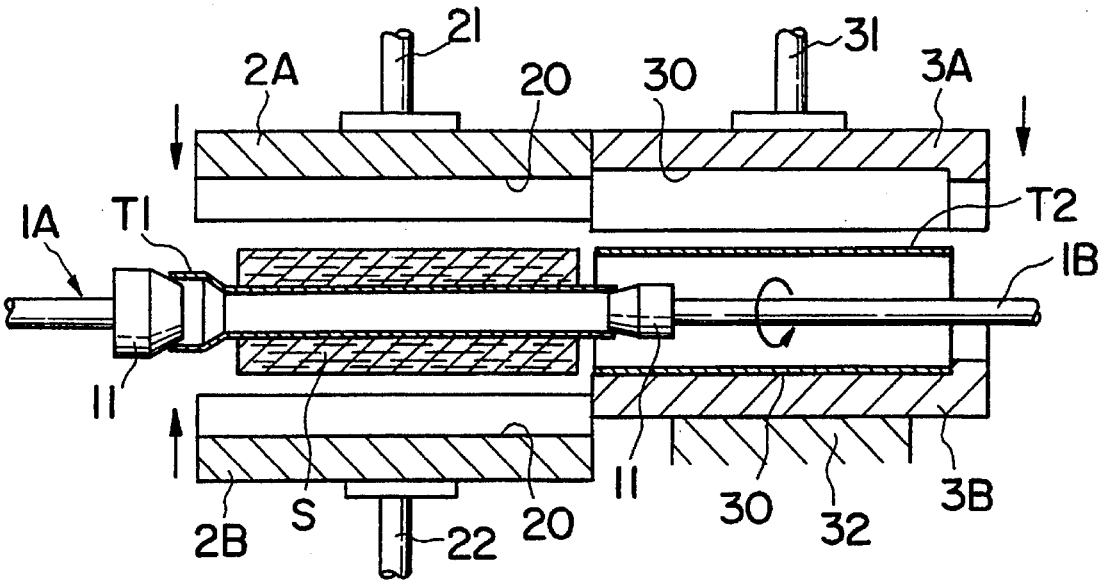

In FIG. 1, which is a longitudinal cross-sectional view showing one example of the apparatus for manufacturing the silencer according to the present invention, reference numerals 1A and 1B designate a pair of left and right spindles, as the inner tube driving means, which holds thereon the inner tube T1 and rotationally drives the same at a predetermined speed, both spindles 1A and 1B being disposed on one and the same rectilinear line, along which they are able to move independently of the other in both left and right directions, as seen on the drawing.

On the mutually opposed ends of the respective spindles 1A and 1B, there are integrally provided centering members 11, 11 in a substantially conical shape. Between these centering pieces 11, 11, the inner tube T1 is held concentrically with the spindles 1A and 1B by fitting and holding its both ends. On either one of the abovementioned spindles 1A, 1B, there is mounted a prime mover such as an electric motor (not shown in the drawing) to cause the inner tube T1 interposed between the spindles 1A and 1B to be rotationally driven at a predetermined speed.

Further, on both upper and lower sides of the spindles 1A and 1B, there are provided a pair of upper and lower levelling members 2A and 2B for reducing the outer diameter of the inner tube T1, on and around which the sound-absorbing material S such as glass wool, etc. has been wound, to a substantially same level as the inner diameter of the outer tube T2, while the inner tube is being rotated in the winding direction (the arrowed direction in the drawing) of the sound-absorbing material. The both levelling members 2A, 2B are made movable up and down by means of their respective supporting rods 21, 22. On the opposed surface sides of the levelling members 2A, 2B, there are formed concaved recesses 20, 20, each being semi-circular in cross-section and substantially equal to the inner diameter of the outer tube T2, as shown FIG. 2. Furthermore, of both end corner parts 20*a*, 20*b* in the circumferential direction of the semi-circular concaved part 20 in the respective levelling members 2A, 2B, the corner part 20*a* to the front side in the rotational direction (i.e., the abovementioned winding direction) of the inner tube T1 is formed in a curved surface of a substantially arcuate shape.

Moreover, to the lateral sides of the abovementioned levelling members 2A, 2B, there are provided a pair of upper and lower clamps 3A, 3B as the outer tube fixing means for immobilizably fixing the outer tube T2 adjacent to the levelling members. The lower clamp 3B is fixedly mounted on a table 32, while the upper clamp 3A is made movable up and down by a rod 31. On the opposed surface sides of the clamps 3A, 3B, there is formed a hollow part 30 in semi-circular shape having a substantially same diameter as the outer peripheral surface of the outer tube T2. In this hollow part 30, the outer tube T2 is placed at its determined position to clamp-hold it between the two clamps 3A and 3B.

In the above-described construction, when manufacturing the silencer with the sound-absorbing material S being filled in the space between the inner tube T1 and the outer tube T2, the spindle 1B is first moved back rightward, then the outer tube T2 is mounted within the hollow part 30 of the lower clamp 3B, and the upper clamp 3A is descended to clamp-hold the outer tube T2 between the clamps 3A and 3B (vide FIG. 1).

On the other hand, the sound-absorbing material is wound beforehand on and around the outer peripheral surface of the inner tube T1 in multiple layers and to a predetermined thickness. Any appropriate winding means may be used: for example, as previously proposed by the present applicant in Japanese Patent Application No. 5-22036, a long web of thin mat-shaped sound-absorbing material stocked in the form of a coil or a roll is sequentially wound on and around the outer peripheral surface of the inner tube T1, and, upon its winding to a predetermined thickness, the web of the material is severed by means of a cutter, or the like. By the way, in the abovementioned patent application, the sound-absorbing material is impregnated with water to fill in the space between the inner and outer tubes. In the present invention, however, the material can be filled in either with or without soaking of water, etc. It is also permissible, though not essential, to use the aforedescribed conventional binding agent, etc. to an extent such that no mal-effect is caused to the silencing performance.

Figure 2A:
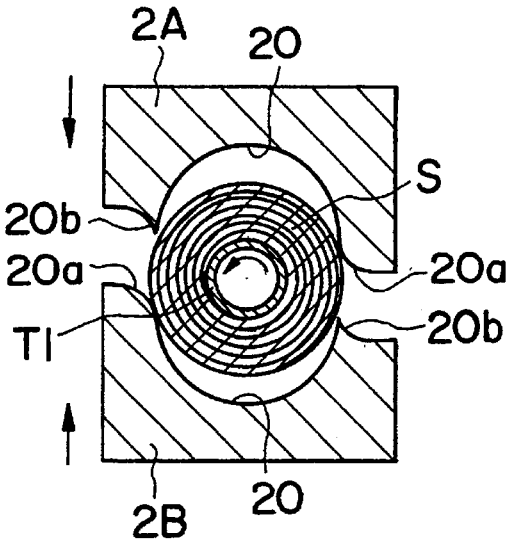
Figure 2B:
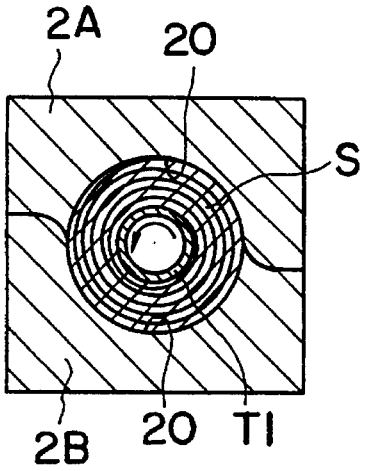

In the next place, the inner tube T1, on and around which the sound-absorbing material S has been wound in the manner as mentioned above, is clamp-held between the spindles 1A and 1B, and then the levelling members 2A, 2B are brought closer each other, while rotating the inner tube T1 in the winding direction of the sound-absorbing material S by means of the spindles 1A and 1B, as shown by the arrow mark in FIG. 2(*a*). As the levelling members come closer to each other, the sound-absorbing material S on and around the inner tube T1 is gradually tightened and reduced in diameter due to rotation of the inner tube T1 in the winding direction of the sound-absorbing material S, and, at the same time, the outer peripheral surface of the sound-absorbing material S, while is sliding on the inner surface of the semi-circular concaved parts 20, 20 of the levelling members 2A, 2B, is gradually levelled in a shape conformable to the shape of the inner surface of the concaved parts 20, 20. At a point where both levelling members 2A and 2B are tightly closed, as shown in FIGS. 2(*b*) and 3(*a*), the outer peripheral surface of the sound-absorbing material S is shaped to have a substantially same diameter as the inner diameter of the outer tube T2.

Figure 4:
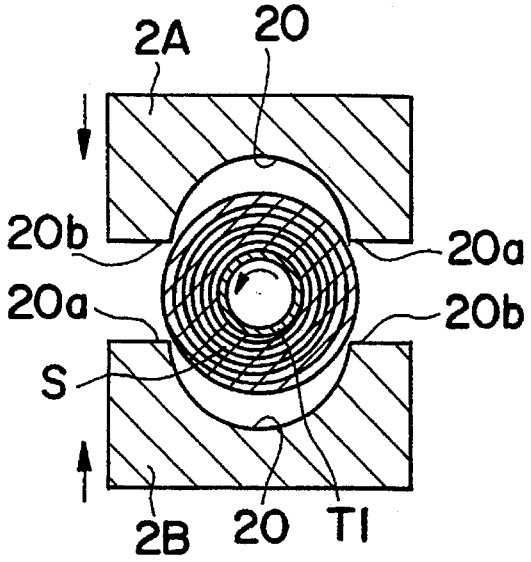
Figure 4:
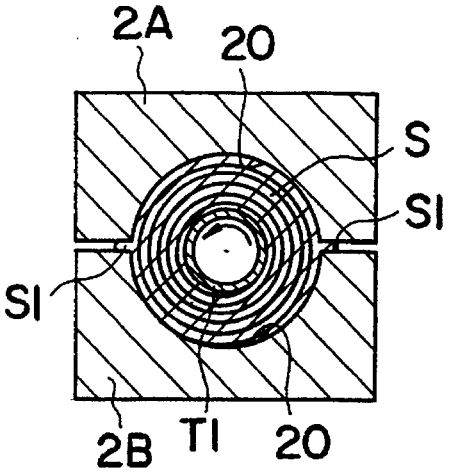

In this occasion, if and when both end corner parts 20*a*, 20*b* in the circumferential direction of the concaved parts 20, 20 of the levelling members 2A, 2B (particularly, the abovementioned corner part 20*a* to the front side or leading edge in the rotational direction) are formed to have the right angle, as shown, for example, in FIG. 4(*a*), there is a possibility such that the outer peripheral surface of the sound-absorbing material S is vigorously rubbed by the corner part 20*a* to cause the sound-absorbing material in small pieces to scatter around, or a portion S1 of the sound-absorbing material S is caught in between the two levelling members 2A, 2B as shown in FIG. 4(*b*). With this corner part 20*a* being formed to have the curved surface as shown in FIG. 2, however, such inconvenience as mentioned above can be eliminated, although a substantially same effect can be obtained, even when the corner part 20*a* is formed to have a slant surface, for example.

Figure 3:
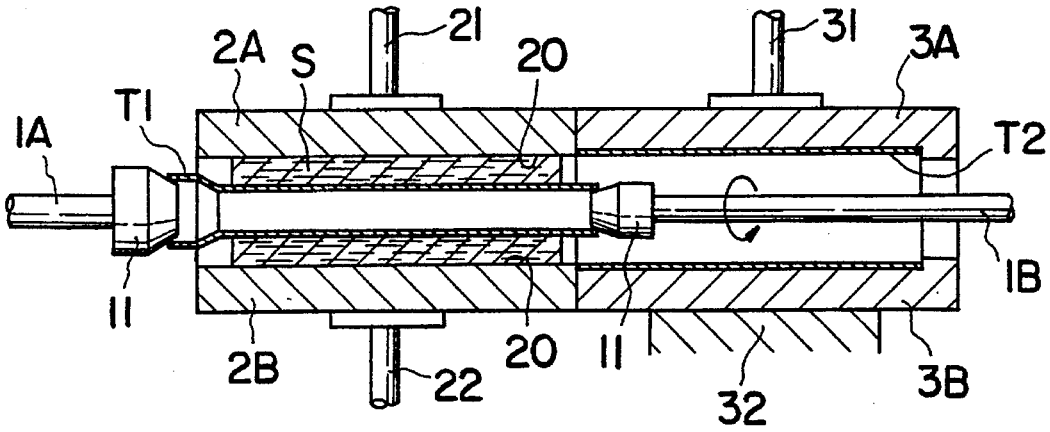
Figure 3:
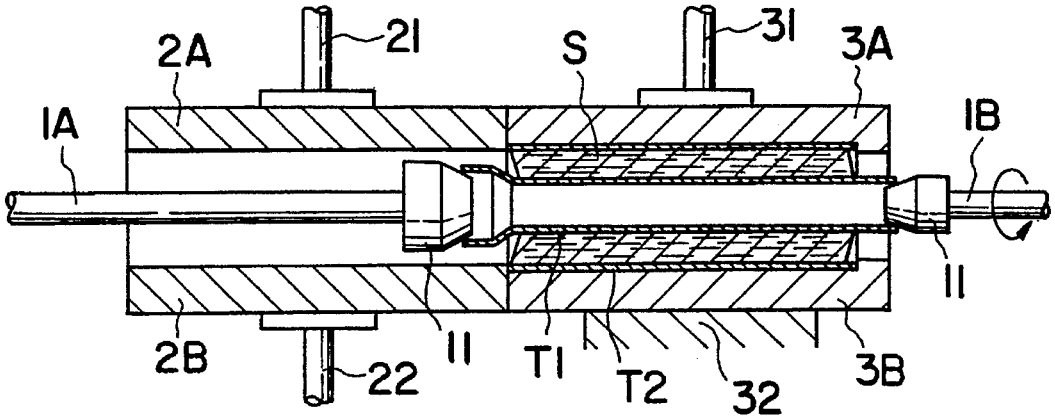
Figure 3:
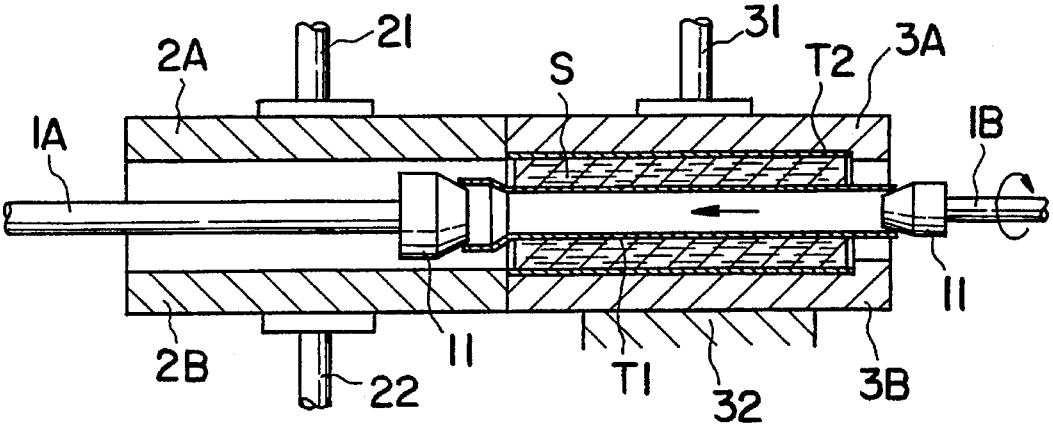

Then, as shown in FIG. 3(*a*), when the outer peripheral surface of the sound-absorbing material S has been shaped to have a substantially same diameter as the inner diameter of the outer tube T2, the spindles 1A and 1B are moved to the right as viewed on the drawing, while continuously rotating the inner tube T1 by means of the spindles 1A and 1B, to thereby forward the inner tube T1 and the sound-absorbing material S into the outer tube T2 which is immovably fixed by the clamps 3A and 3B, as shown in FIG. 3(*b*), whereupon the outer peripheral surface of the sound-absorbing material S moves within the outer tube T2 along its axial direction, while rotating in the circumferential direction, hence the insertion can be done smoothly with less frictional resistance.

By the way, after the movement and the rotation of the inner tube T1 by the spindles 1A, 1B are stopped once at a point where the inner tube T1 and the sound-absorbing material S have been inserted in the outer tube T2 to their predetermined position, when the spindles 1A and 1B are reversely rotated as shown in FIG. 3(*c*) to cause the inner tube T1 to rotate in the direction opposite to the abovementioned winding direction of the sound-absorbing material S wound on the inner tube T1, the winding force of the sound-absorbing material S onto this inner tube T1 becomes weak, whereby the sound-absorbing material S, due to its elastic restitutive force, can be distributed in the space between the inner tube T1 and the outer tube T2, without deviation, and its packing density can be made uniform.

Also, in the state of the inner tube T1 and the sound-absorbing material S having been inserted in the outer tube T2 to their predetermined position, as shown in FIG. 3(*b*), if and when the outer peripheral surface side of the sound-absorbing material S is displaced to a certain extent in the direction opposite to the abovementioned direction of insertion due to the frictional force between the sound-absorbing material and the outer tube T2, the spindles 1A and 1B may, for example, be moved back slightly in the direction opposite to the abovementioned direction of insertion simultaneously with the abovementioned reversing operation, whereby the abovementioned displacement can be rectified as shown in FIG. 3(*b*).

Figure 6:
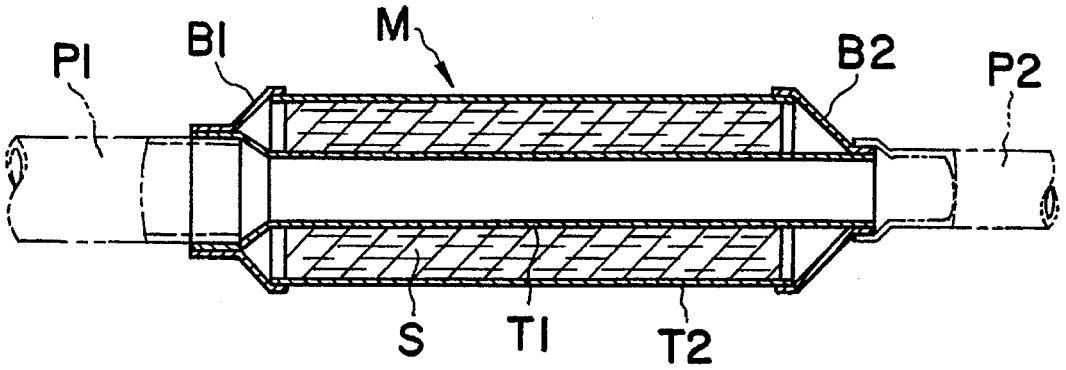
FIG. 6 is a longitudinal cross-sectional view showing one embodiment of a sound-absorbing type silencer.
Figure 7:
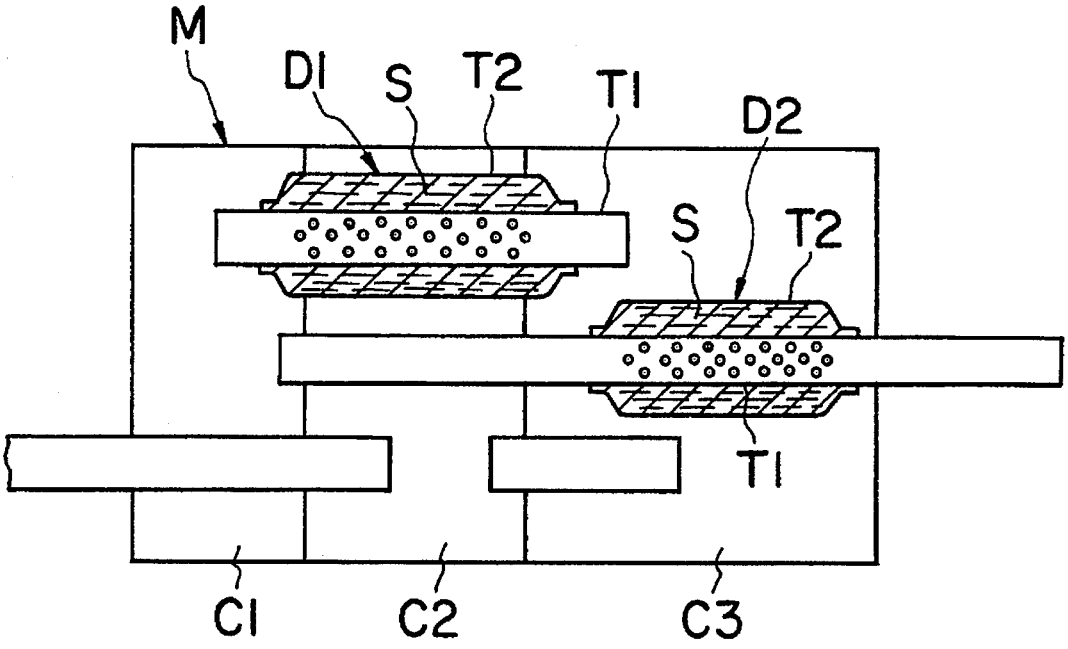
FIG. 7 is a longitudinal cross-sectional view showing one embodiment of a buffle type silencer.
Figure 8A:
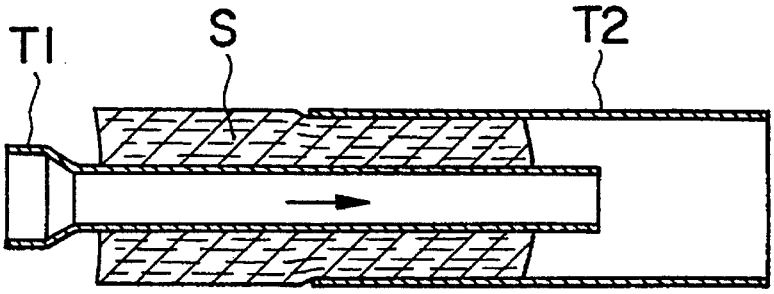
FIGS. 8(*a*) and 8(*b*) are explanatory diagrams of the conventional manufacturing processes.
Figure 8B:
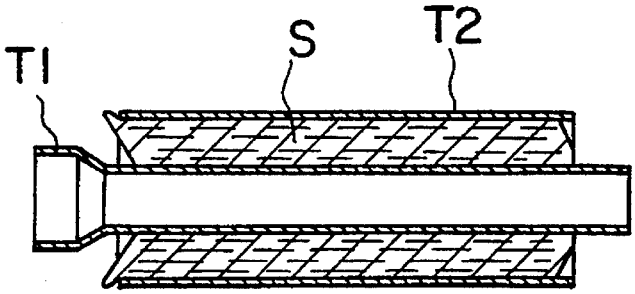

In this manner, when the abovementioned end plates B1 and B2 are fixed by welding, etc. onto both end parts of the inner tube T1 and the outer tube T2 with the sound-absorbing material S having been filled in the space between them, as described in the foregoing, there can be obtained the silencer as shown FIG. 6. The same in process steps are applicable to the case of manufacturing the silencer as shown in FIG. 7.

Incidentally, both end parts of the abovementioned inner tube T1 and the outer tube T2 can be closed by the drawing work, etc., after the sound-absorbing material is filled in between them, without use of the abovementioned end plates B1 and B2.

Figure 5:
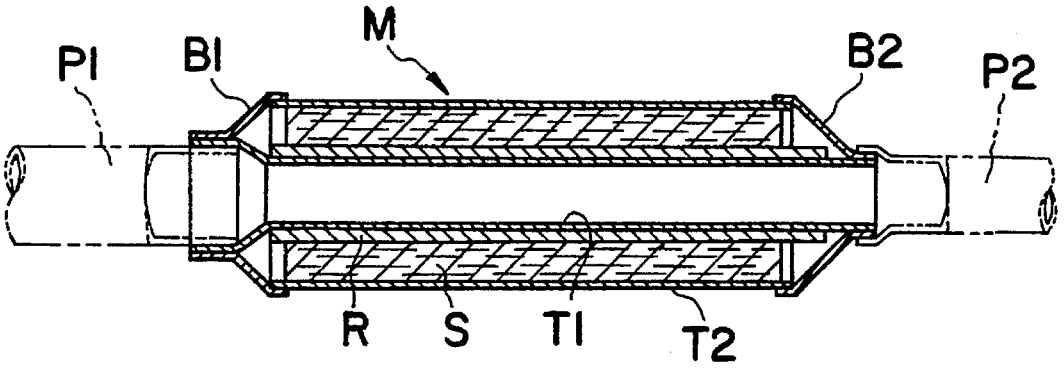
FIG. 5 is a longitudinal cross-sectional view showing another embodiment of the silencer which can be manufactured according to the present invention.

The sound-absorbing material S is not limited to glass wool, but any other materials having sound-absorbing property can also be utilized. Further, in order to prevent glass wool, or other sound-absorbing materials from scattering around, there can also be provided a scatter-preventing material R such as stainless steel wool, or heat-resistant woven or unwoven cloth on the inner surface of such sound-absorbing materials as shown, for example, in FIG. 5.

As has so far been explained in the foregoing, the method of manufacturing the silencer and the apparatus for manufacturing such silencer according to the present invention are capable of filling, easily and reliably, the sound-absorbing material S in the space between the inner tube T1 and the outer tube T2, without necessity for using the binding agent, etc. as has been done conventionally. It is also possible to automate the filling operation of the sound-absorbing material so that it can be done continuously, whereby the silencers, in which the sound-absorbing material is filled in the space between the inner tube and the outer tube, can be mass-produced at a cheaper cost.

Although, in the foregoing, the present invention has been described in specific details in reference to its preferred embodiments, the invention is not limited to these embodiments alone, but any changes and modifications in the process steps may be made by those persons skilled in the art without departing from the spirit and scope of the invention as set forth in the appended claims.

What is claimed is:

1. An apparatus for manufacturing a silencer with sound-absorbing material filled in a space between a multi-perforated inner tube and an outer tube, which apparatus comprises:

driving means for rotationally driving said inner tube, which driving means holds at least the inner tube thereon and rotationally drives the same at a predetermined speed, said driving means driving said inner tube in a direction of winding of sound absorbing material wound on said inner tube;

a pair of levelling members, each having on mutually opposed surface sides, semi-circular concavities of a size substantially equal to the inner diameter of said outer tube, for leveling the outer diameter of said sound-absorbing material wound on and around said inner tube to a diameter substantially equal to the inner diameter of said outer tube; and means for immobilizably fixing the outer tube, said pair of levelling members being disposed in a manner to be movable in the direction perpendicular to the axial direction of said inner tube as it is rotationally driven by said inner tube driving means, said outer tube immobilizing means being disposed adjacent to said levelling members.

2. An apparatus for manufacturing a silencer as set forth in claim 1, wherein each said levelling member has end corner parts in the circumferential direction of said semi-circular concavity, a corner part at a leading edge in the rotational direction of said inner tube being formed in a curved surface.

* * * * *